US011400677B2

(12) United States Patent
Husmann et al.

(10) Patent No.: US 11,400,677 B2
(45) **Date of Patent: *Aug. 2, 2022**

(54) PORTABLE ROLLER COMPACTOR

(71) Applicants: HUSMANN UMWELT-TECHNIK GMBH, Dörpen an der Ems (DE); Hendrik Alexander Husmann, Papenburg (DE)

(72) Inventors: Heinz Hermann Husmann, Papenburg (DE); Wolfgang Muchall, Papenburg (DE)

(73) Assignee: HUSMANN UMWELT-TECHNIK GMBH, Dörpen an der Ems (DE)

( * ) Notice: Subject to any disclaimer, the term of this patent is extended or adjusted under 35 U.S.C. 154(b) by 197 days.

This patent is subject to a terminal disclaimer.

(21) Appl. No.: 16/879,067

(22) Filed: May 20, 2020

(65) Prior Publication Data

US 2020/0276782 A1 Sep. 3, 2020

Related U.S. Application Data

(63) Continuation of application No. 15/529,153, filed as application No. PCT/EP2015/077649 on Nov. 25, 2015, now Pat. No. 10,696,001.

(30) Foreign Application Priority Data

Nov. 25, 2014 (DE) ..... 20 2014 105 681.5

(51) Int. Cl.
*B30B 9/30* (2006.01)
*B30B 3/02* (2006.01)
(Continued)

(52) U.S. Cl.
CPC ..... *B30B 9/3082* (2013.01); *B30B 3/02* (2013.01); *B30B 9/205* (2013.01); *B30B 9/3042* (2013.01); *B30B 9/327* (2013.01); *B30B 15/165* (2013.01)

(58) Field of Classification Search
CPC .... B30B 3/02; B30B 15/0023; B30B 15/0064
See application file for complete search history.

(56) References Cited

U.S. PATENT DOCUMENTS 4,467,714 A 8/1984 Bergmann
7,100,500 B2 9/2006 Soler
(Continued)

FOREIGN PATENT DOCUMENTS

DE 102005029199 A1 1/2007
DE 202011000241 U1 7/2011
(Continued)

OTHER PUBLICATIONS

International Search Report dated Feb. 3, 2016 in related International Application No. PCT/EP2015/077649.
(Continued)

*Primary Examiner* — Shelley M Self
*Assistant Examiner* — Katie L. Parr
(74) *Attorney, Agent, or Firm* — Patent Portfolio Builders PLLC

(57) ABSTRACT

A portable roller compactor for compacting waste located in a container, which is open on the top, has a frame-like basic structure and an articulated arm, one end of which is supported by the basic structure, and the other, free end of which supports a roller compactor that essentially can be rotated about a horizontal axis of rotation. The articulated arm of the roller compactor is pivotably attached to a sliding carriage, which is mounted on the frame-like base structure and can be moved in a longitudinal direction.

9 Claims, 7 Drawing Sheets

Figure 1:
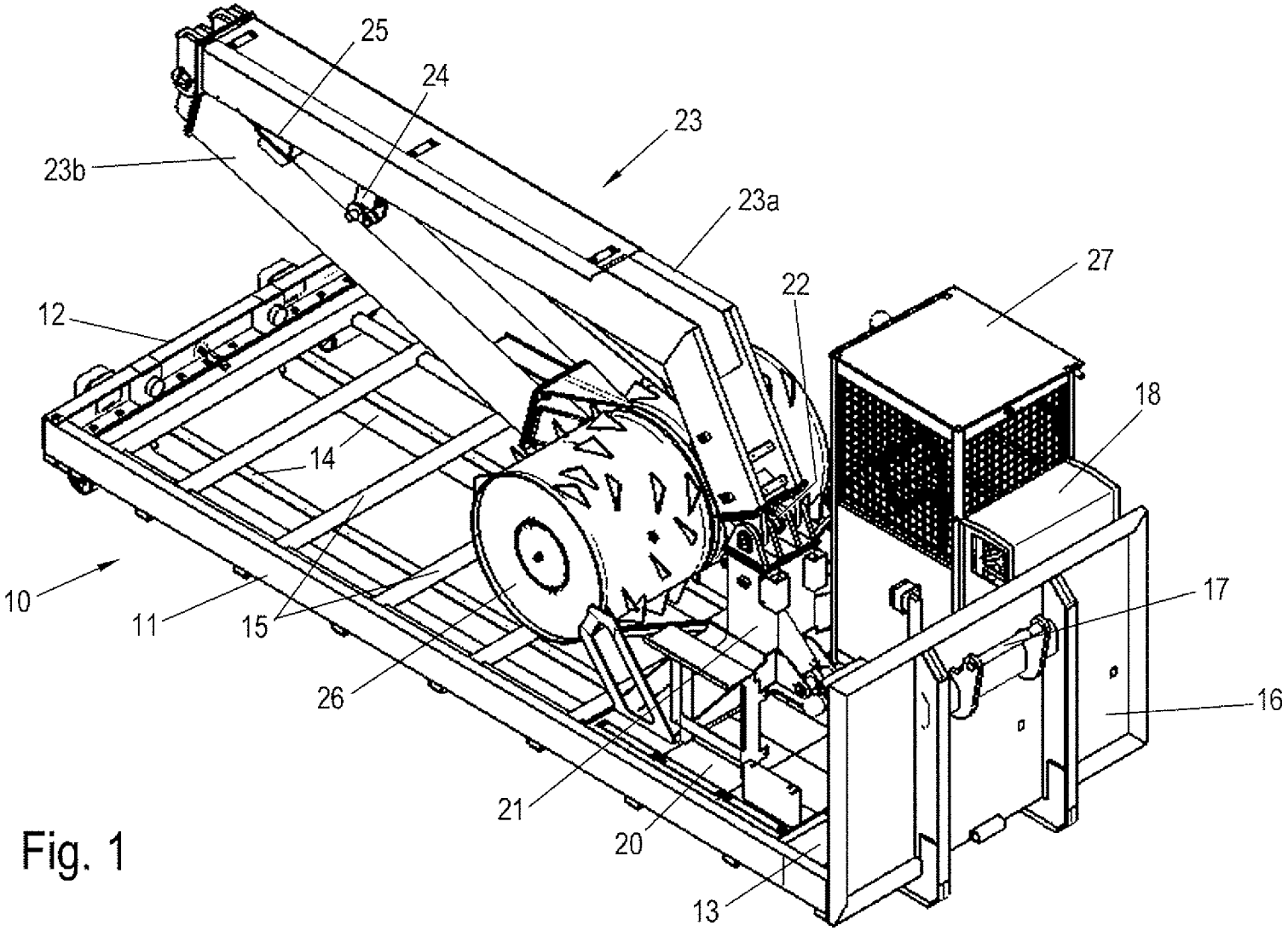

(51) Int. Cl.

| | |
|---|---|
| ***B30B 9/20*** | (2006.01) |
| ***B30B 9/32*** | (2006.01) |
| ***B30B 15/16*** | (2006.01) |

(56) References Cited

U.S. PATENT DOCUMENTS

| | | | | |
|---|---|---|---|---|
| 2003/0230656 | A1 | 12/2003 | LaBarbera | |
| 2004/0018076 | A1 | 1/2004 | Poindexter | |
| 2007/0222259 | A1 | 9/2007 | Oliver | |
| 2013/0042769 | A1* | 2/2013 | Herrmann | B65B 11/025 100/8 |

FOREIGN PATENT DOCUMENTS

| | | | | | |
|---|---|---|---|---|---|
| EP | 1736304 | A2 * | 12/2006 | ..... | B30B 9/3082 |
| EP | 1513674 | B1 | 4/2009 | | |
| EP | 2110229 | A2 * | 10/2009 | ..... | B30B 9/3082 |
| EP | 2110229 | A2 | 10/2009 | | |
| SU | 934984 | A2 | 6/1982 | | |
| WO | 9321007 | A1 | 10/1993 | | |
| WO | 03101716 | A1 | 12/2003 | | |
| WO | WO-2006027520 | A1 * | 3/2006 | ..... | B30B 9/3082 |

OTHER PUBLICATIONS

Written Opinion dated Feb. 3, 2016 in related International Application No. PCT/EP2015/077649.

* cited by examiner

PORTABLE ROLLER COMPACTOR

BACKGROUND AND SUMMARY OF THE INVENTION

Exemplary embodiments of the invention relate to a transportable roller compactor for compacting waste located in an open-top container. The roller compactor has a frame-like base structure, which can be mounted on a loading surface of a truck or trailer. The base structure carries an articulated arm, which at a free end carries a roller compactor, which is rotatable about a horizontal axis of rotation.

For compacting waste in a container, such a transportable roller compactor is mounted on a loading surface of a truck or trailer and then moved to a front side of an upwardly open container. The compactor roller located at the free end of the articulated arm is lowered into the container. In a pivoting movement of the articulated arm, the compactor roller is moved back and forth in the container, thereby compressing and/or comminuting the waste in the container. The compactor roller is usually rotatable by means of a drive and has a structured surface, for example, with protruding spikes or teeth, in order to be able to effectively comminute and compact the waste in the container.

A transportable roller compactor of this type is known, for example, from the European patent publication EP 1 513 674 B1. The articulated arm of this construction is composed of three mutually pivotable sections and is pivotally mounted at the rear end of the frame of the base structure. By means of at least two hydraulic cylinders, the section of the articulated arm that is rotatably mounted on the frame can be pivoted against the frame and the middle section of the articulated arm can be pivoted towards the frame-mounted section. The section of the articulated arm carrying the compactor roller is connected to the middle section in a free-swinging manner. From the working position at which the compactor roller is located in the container, the articulated arm can be brought into a transport position that is as flat as possible by first placing the middle section of the articulated arm as high as possible and almost vertically, and then pivoting the entire articulated arm via the pivot joint at its base onto the frame-like base structure. During the transition from rest to the working position, these pivoting movements are performed in the reverse order. The motion kinematics of the articulated arm can, however, be complicated because of the three-part design. In addition, the section of the articulated arm pivotably mounted on the frame must be able to be pivoted between a position that is as horizontal as possible and a vertical position without the free space under the frame construction being available for the used hydraulic cylinder. This produces unfavorable lever ratios when pivoting said frame-mounted section of the articulated arm out of its horizontal position.

German patent publication DE 10 2005 029 199 B4 also shows a transportable roller compactor with an articulated arm, which can be loaded onto a loading surface of a truck. In this case, the articulated arm is formed only from two sections that can be pivoted towards one another, one of which carries the compactor roller and the other is pivotably mounted on a support column mounted (as viewed in the direction of travel of the truck) at the rear end of the base of the roller compactor. Through the support column the pivot joint of the pivot arm lies above the frame construction. A transition from the rest to the working position and vice versa is achieved in this roller compactor by a single pivoting movement of the articulated arm, wherein the pivotable section of the articulated arm is pivoted over the support column and is deposited on the frame construction. For this purpose, the pivot joint on the support column is designed such that it permits a pivoting movement through an angle of at least 90° about the horizontal axis. Due to the large pivot angle, the realization of the pivoting movement by a hydraulic drive is also complex in this construction.

In the case of the two aforementioned transportable roller compactors, the compactor roller is located, relative to the travelling direction, in the rear region of the roller compactor in the rest position, i.e., in the position in which the roller compactor is transported. Since the compactor roller has a substantial share of the weight of the roller compactor, this results in an unfavorable weight distribution for transport.

Accordingly, exemplary embodiments of the present invention are directed to a transportable roller compactor in which a transition from a rest position of the articulated arm into a working position can be effected by uncomplicated movements of the articulated arm and in which, in a rest position, the articulated arm is folded onto the base structure. The compactor roller is preferably positioned in a front portion of the roller compactor.

A transportable roller compactor according to the invention of the type mentioned above includes the articulated arm pivotably mounted on a carriage, which is mounted on the frame-like base structure, so as to be displaceable in a longitudinal direction.

Because the articulated arm is not mounted directly on the base, its mounting point on the base structure can be changed between a rest position for the articulated arm and a working position, thus allowing a rest position to be set in a favorable weight distribution of the roller compactor. In addition, the transition between rest and working position requires only a small pivot angle for the articulated arm because it no longer has to be pivoted over its mounting point.

In an advantageous embodiment of the transportable roller compactor, the frame-like base structure has longitudinal beams running on both longitudinal sides and on which the carriage is guided. The longitudinal beams required for mechanical stabilisation in any case, are used as guides for the movable carriage, as a result of which additional guide rails can be dispensed with.

In a further advantageous embodiment of the transportable roller compactor, the articulated arm is pivotably mounted on the carriage via a pivot joint and a support column. Preferably, the pivot joint has a pivot angle of less than 90° and preferably less than 75°. Such a small pivot angle is sufficient, since the articulated arm does not have to be pivoted over the support column because of the movable carriage for assuming the rest position.

In a further advantageous embodiment of the transportable roller compactor, the carriage can be moved on the base structure by means of a chain or rack drive that is operated hydraulically or electromotively. Both types of drive can be implemented in a simple and space-saving manner.

In a further advantageous embodiment of the transportable roller compactor, the articulated arm has two articulated arm members, which can be pivoted relative to each other, of which a first articulated arm member, which is mounted on the carriage, is cranked. The configuration of the articulated arm with only two parts simplifies its construction and movement kinematics. In the rest position, the cranked articulated arm member permits a space-saving positioning of the compactor roller under the first articulated arm member while the support column is simultaneously low.

Particularly preferably, the compactor roller is deposited in the rest position on the movable carriage. In the rest position of the articulated arm, the carriage is preferably located on a front end of the frame-like base structure, as viewed in the direction of transport, while in the working position of the articulated arm it is located at a rear end of the frame-like base structure, as viewed in the direction of transport.

BRIEF DESCRIPTION OF THE DRAWING FIGURES

Figure 6B:
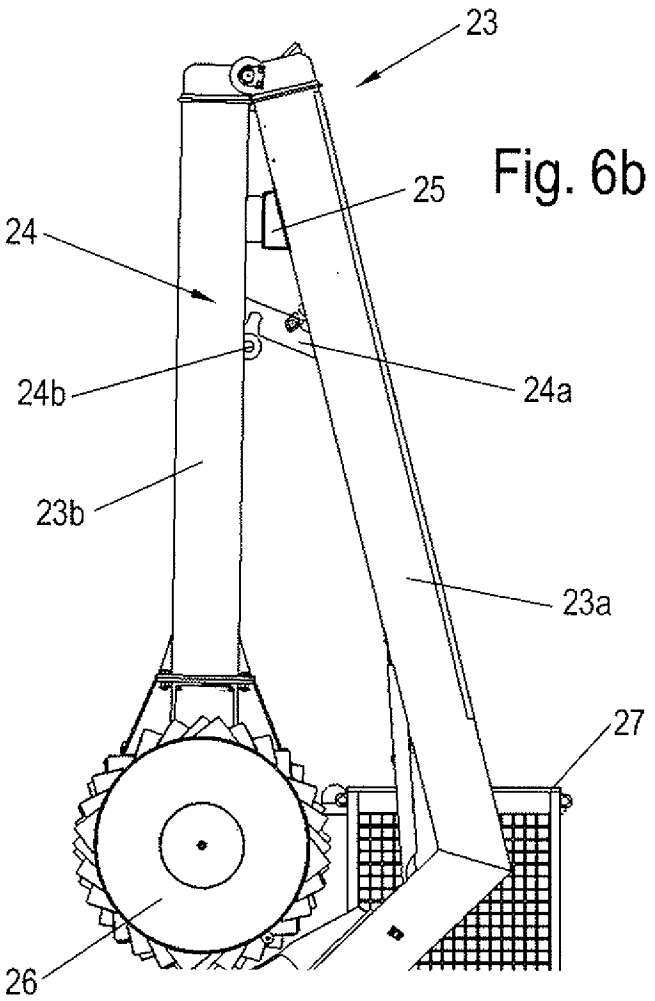
Figure 6A:
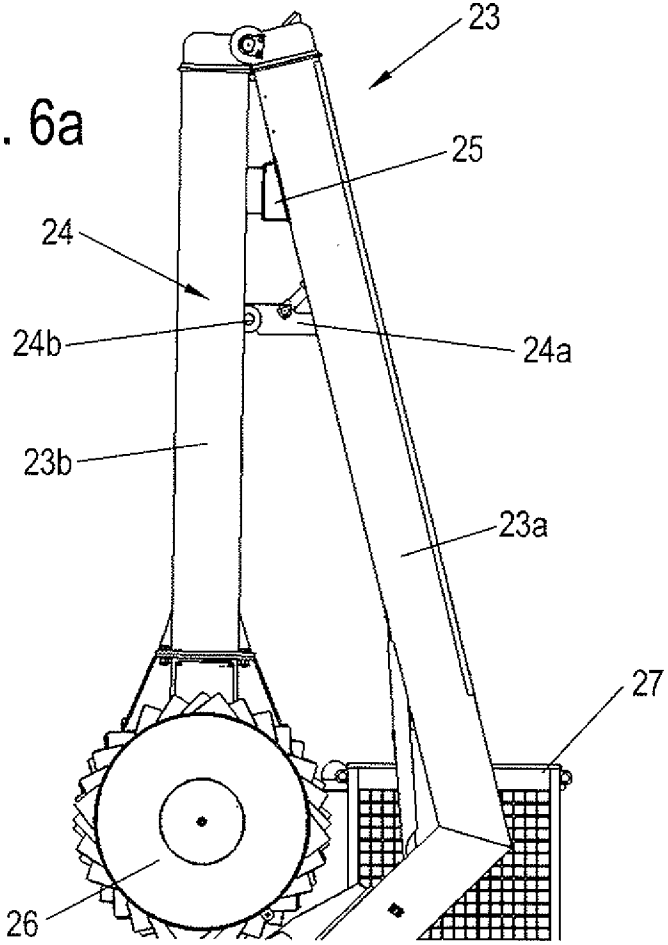
Figure 7:
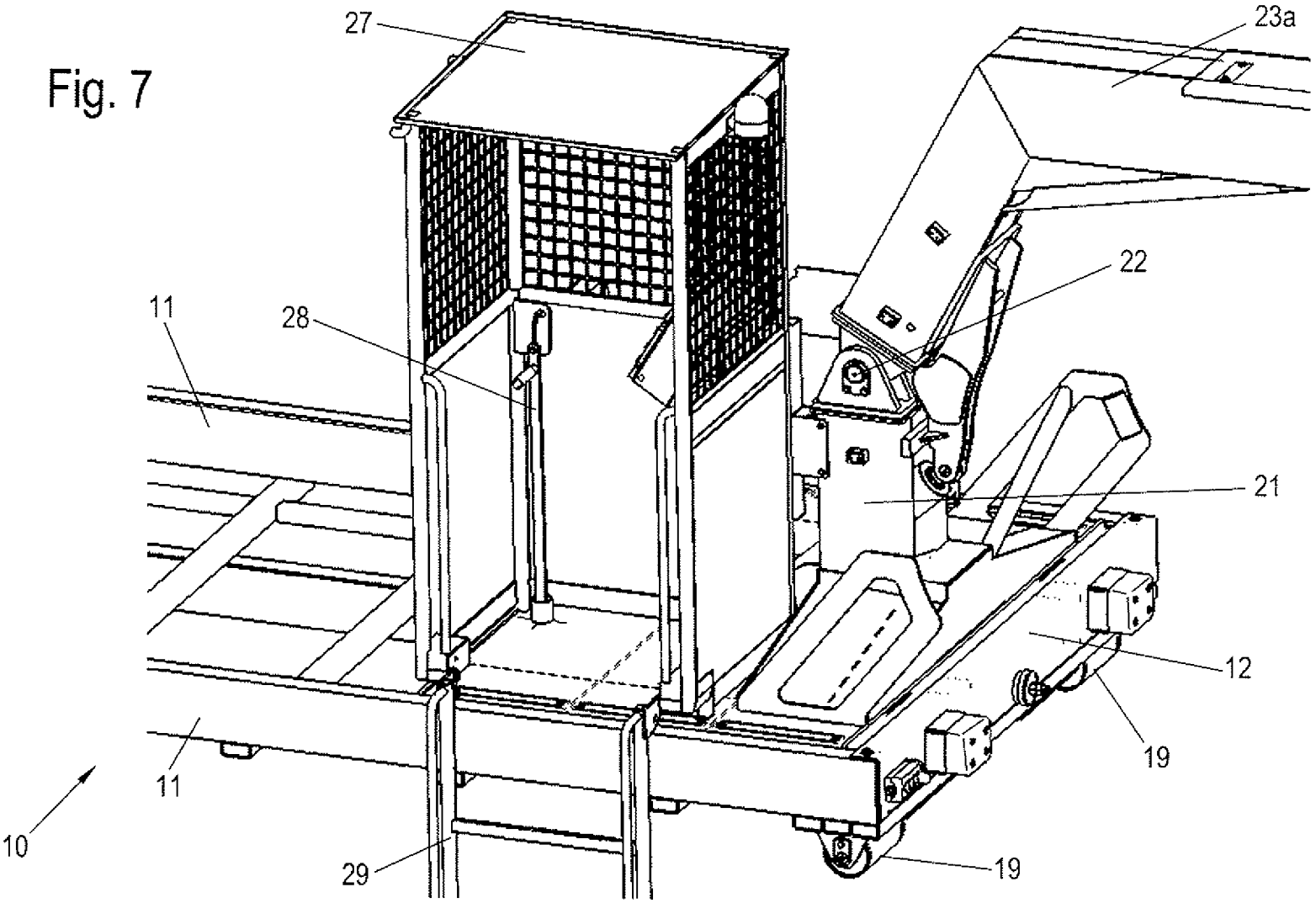

The invention is explained below in closer detail with reference to an exemplary embodiment shown in the drawings, wherein:

FIGS. 1 to 5 each show a symmetrical overall view of a transportable roller compactor in various operating states;

FIGS. 6*a*, 6*b* each show a side view of a part of the transportable roller compactor in two different states; and FIG. 7 shows shows a further detailed view of the transportable roller compactor shown in an isometric view.

DETAILED DESCRIPTION

FIGS. 1 to 5 show an embodiment of a transportable roller compactor according to the application, each in isometric view.

The drawings show the roller compactor in various operating states from a respective similar viewing direction. Referring to the figures, a transition of the roller compactor is shown from a rest state, in which a transport of the roller compactor can take place, to an operating state in which waste in a container is compressed and/or crushed.

The roller compactor has a base structure 10, which corresponds in its dimensions, in particular in the dimensions of its base, to a conventional container. The base structure 10 is formed in a frame-like manner with outer longitudinal beams 11, a rear transverse beam 12 and a front transverse beam 13, which is only visible in the drawings. The directional indication at the front or the rear relates to the usual transport direction of the transportable roller compactor, if this is mounted on a truck or a trailer of a truck.

Further stabilising elements of the base structure 10 are bearers 14 in the form of T-beams or double T-beams with which the roller compactor rests on the base. Further transverse beams 15 are arranged for stabilization via the longitudinal extension of the base structure 10.

At the front end, the base structure 10 has an end wall 16 on which an eyelet 17 is arranged. Size and dimensioning of the end wall 16 as well as the position of the eyelet 17 are modelled on commercially available containers in order to be able to also use the apparatus for winding containers onto a truck for pulling on the roller compactor. On the inner side of the end wall 16 a supply cabinet 18 is arranged, which accommodates a drive unit, for example in the form of a hydraulic pump and/or control devices for the transportable roller compactor. For configurations in which an electrical drive of the roller compactor is provided, a current connection to the power supply can also be provided via the supply cabinet.

A movable carriage 20, which carries the further components of the roller compactor, is arranged on the base structure 10. The carriage 20 is guided in the longitudinal beams 11 of the base structure 10, for example, by means of wheels or rollers or sliding elements. The carriage 20 can be moved over substantially the entire length of the base structure 10. For this purpose, a displacement drive is provided, which can be operated in a hydraulically, electrically, or diesel-hydraulic manner. A drive motor, which is not shown in detail in the figures, can either be mounted on the base structure 10, wherein the transmission to the carriage 20 occurs via a chain or cable pull. Alternatively, it can be provided to mount the drive motor on the carriage 20, wherein the drive motor acts on a toothed rack or a chain with an Ω loop, which is fixed to the base structure 10.

The supply cabinet 18, which is arranged in the illustrated embodiment on the rear side of the end wall 16 on the base structure 10, can also be positioned on the movable carriage 20 in alternative embodiments. In this case, a cable drag with moved hydraulic lines and control lines can advantageously be dispensed with.

On the carriage 20, an articulated arm 23 is pivotably mounted on a support column (also referred to as a mast foot) 21 via a pivot joint 22, which articulated arm in the illustrated embodiment comprises two articulated arm members 23*a*, 23*b*, which are connected to each other in an articulated manner. At the free end of the articulated arm 23, a compactor roller 26 is arranged, which is rotatable about a substantially horizontal axis of rotation. The compactor roller 26 can preferably be actively rotated, for example via a hydraulic motor arranged in its interior. The articulated arm 23 can be pivoted with respect to the support column 21 via a hydraulic cylinder (not shown in detail). A further hydraulic cylinder can optionally be provided with which the articulated arm member 23*b* can be pivoted against the articulated arm member 23*a*. In the illustrated embodiment, however, it is provided that the articulated arm member 23*b* can oscillate freely about the articulated arm member 23*a* and thus follows the movement of the (driven) compactor roller 26 in the container.

In the illustrated embodiment, the first articulated arm member 23*a* mounted on the support column 21 is cranked. As can be seen in the rest position (transport position) of the articulated arm 23 shown in FIG. 1, space for the compactor roller 26 is provided by the cranked articulated arm member 23*a* in conjunction with the support column 21 when the second articulated arm member 23*b* is folded beneath the first articulated arm member 23*a*, as illustrated. This results in a low height of the roller compactor in the transport state, wherein, at the same time, the compactor roller 26, which constitutes a substantial part of the weight of the roller compactor, is positioned in a front region (again relative to the direction of transport) of the base structure 10 of the roller compactor.

Figure 5:
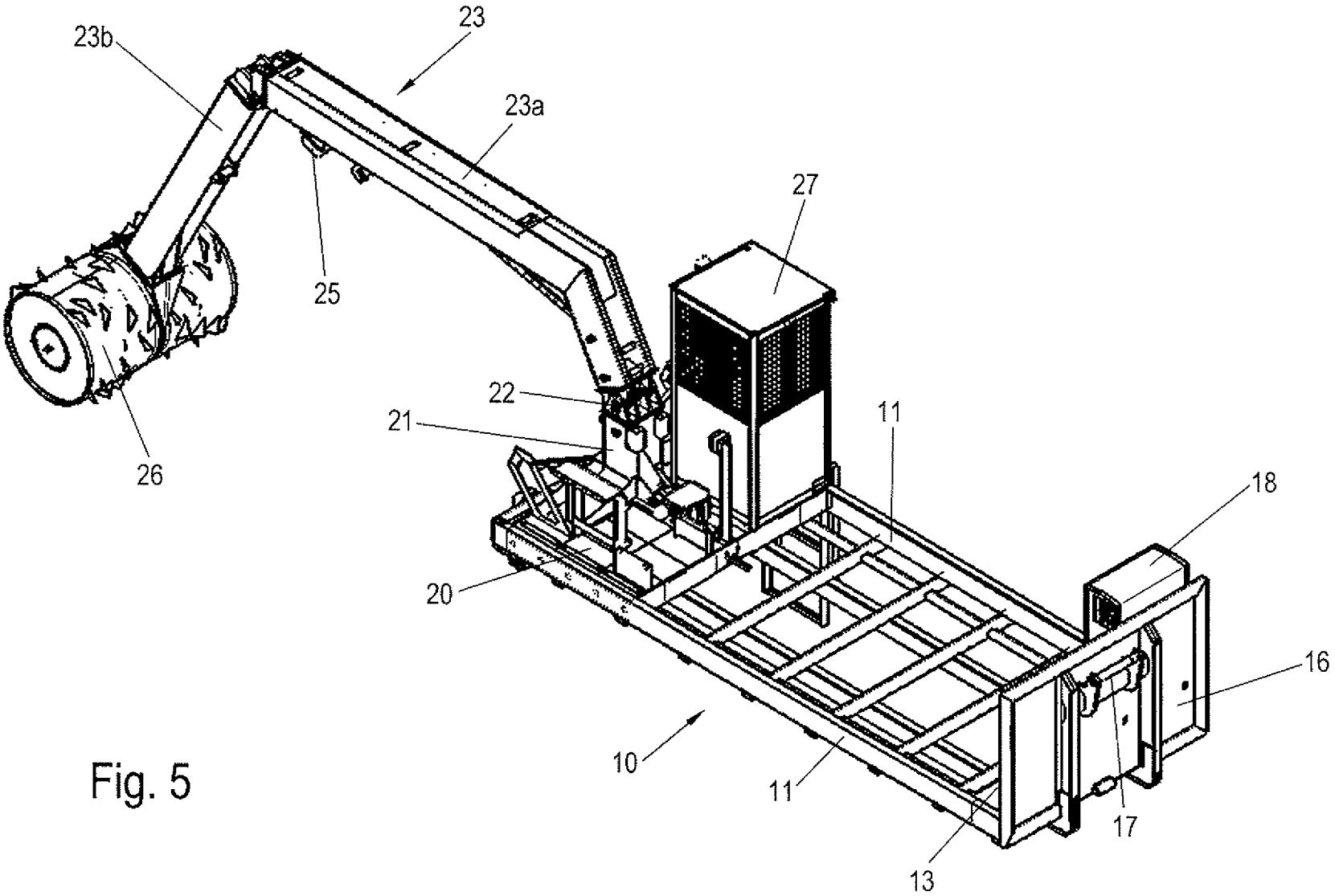

FIGS. 2-5 show the transition from the rest position shown in FIG. 1 to a working position of the articulated arm 23 shown in FIG. 5 in a comparable isometric view as in FIG. 1. In order to compact waste in a container, the roller compactor pulled onto a truck or trailer is initially moved rearwardly against the container so that the roller compactor rests with its rear end (in the region of the rear transverse beam 12) against an upper edge of the container.

Figure 2:
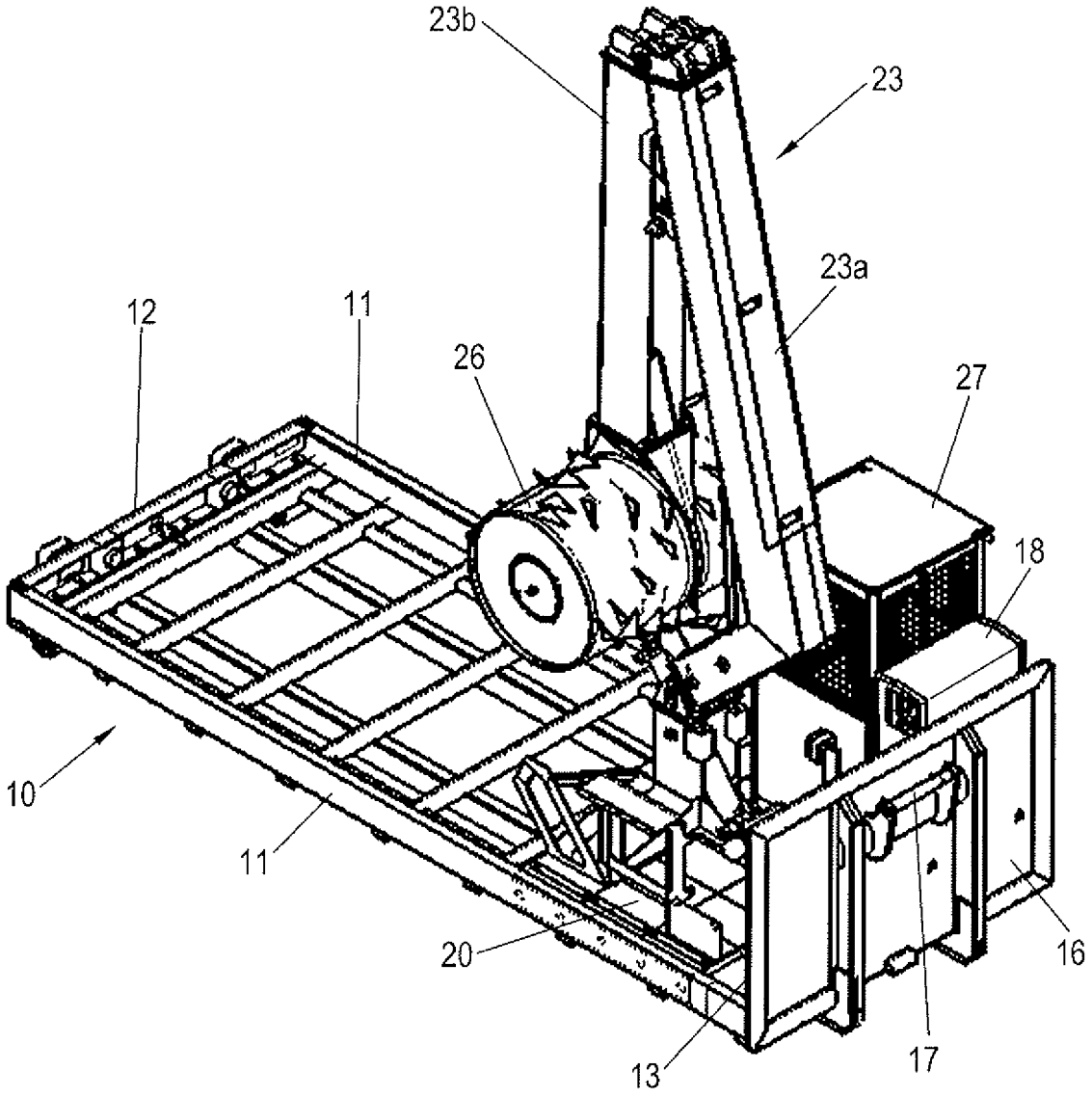

In a first step, as shown in FIG. 2, the articulated arm 23 is set upright at first by pivoting about the pivot joint 22. The position of the swivel arm members 23*a* and 23*b* relative to each other is thereby maintained. In the case of a second articulated arm member 23*b*, which can be actively pivoted against the first articulated arm member 23*a* via a hydraulic cylinder, this can be achieved via the hydraulic cylinder. When the second articulated arm member 23*b* is mounted so as to oscillate freely against the first articulated arm member 23*a*, a hooking apparatus 24 is provided, which is shown in more detail in FIGS. 6*a* and 6*b*.

The hooking apparatus 24 comprises a bar 24*a*, which is mounted so as to be pivotable on an articulated arm member, in this case the first articulated arm member 23*a*. In a locked position, shown in FIG. 6*a*, the bar 24*a* engages with a correspondingly shaped cutout about a pin 24*b*, which is mounted on the second pivot arm member 23*b*. Correspondingly, the articulated arm members 23*a*, 23*b* are no longer pivotable relative to one another in the position of the bar 24*a* shown in FIG. 6*a*. On the other hand, as shown in FIG. 6*b*, when the bar 24*a* is no longer in engagement with the pin 24*b*, the second articulated arm member 23*b* can oscillate freely against the first articulated arm member 23*a*. In order to prevent abutment of the compactor roller 26 on the cranked portion of the first articulated arm member 23*a*, a stop 25, for example in the form of a rubber buffer, is arranged on one of the articulated arm members 23*a*, 23*b*.

Figure 3:
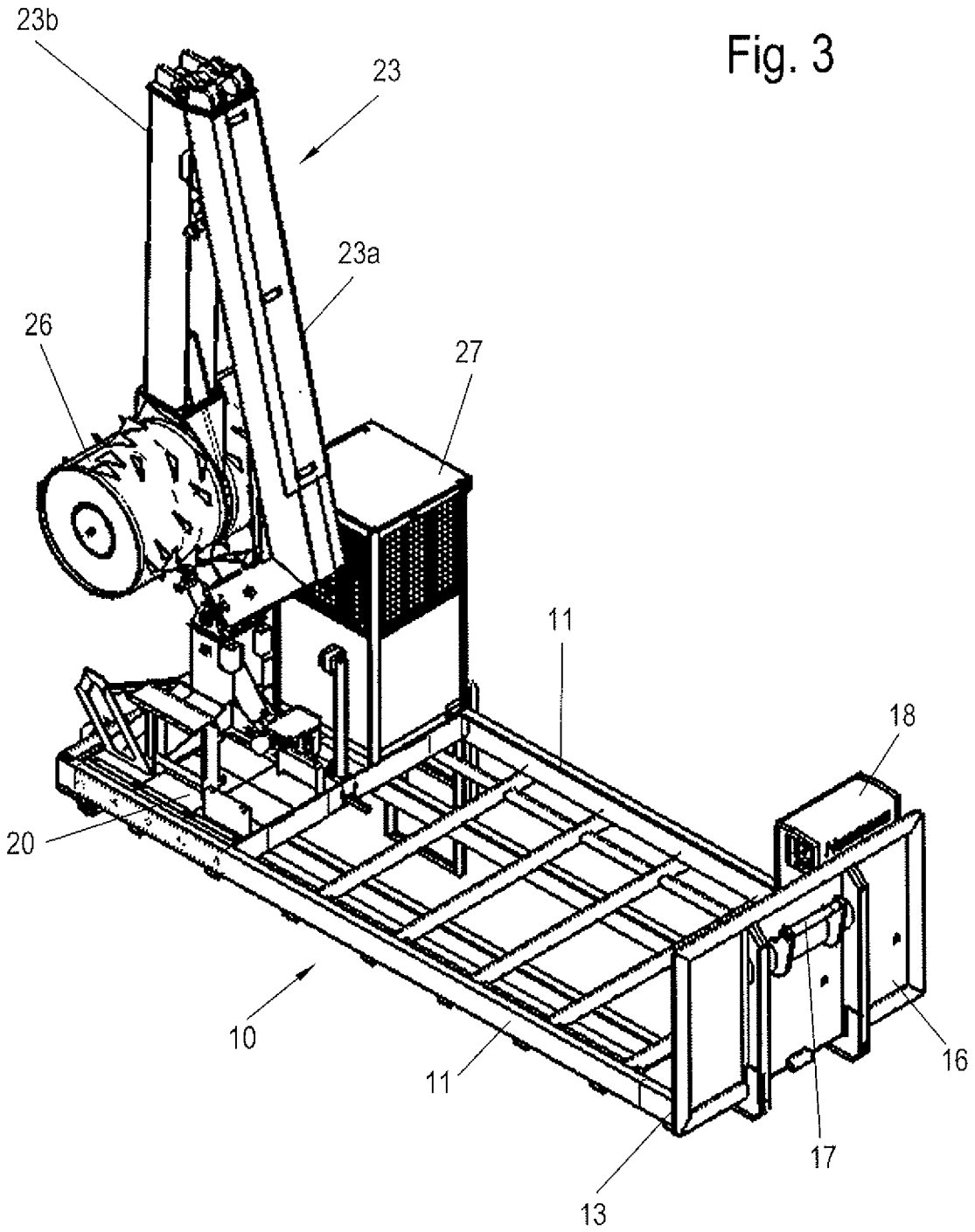
Figure 4:
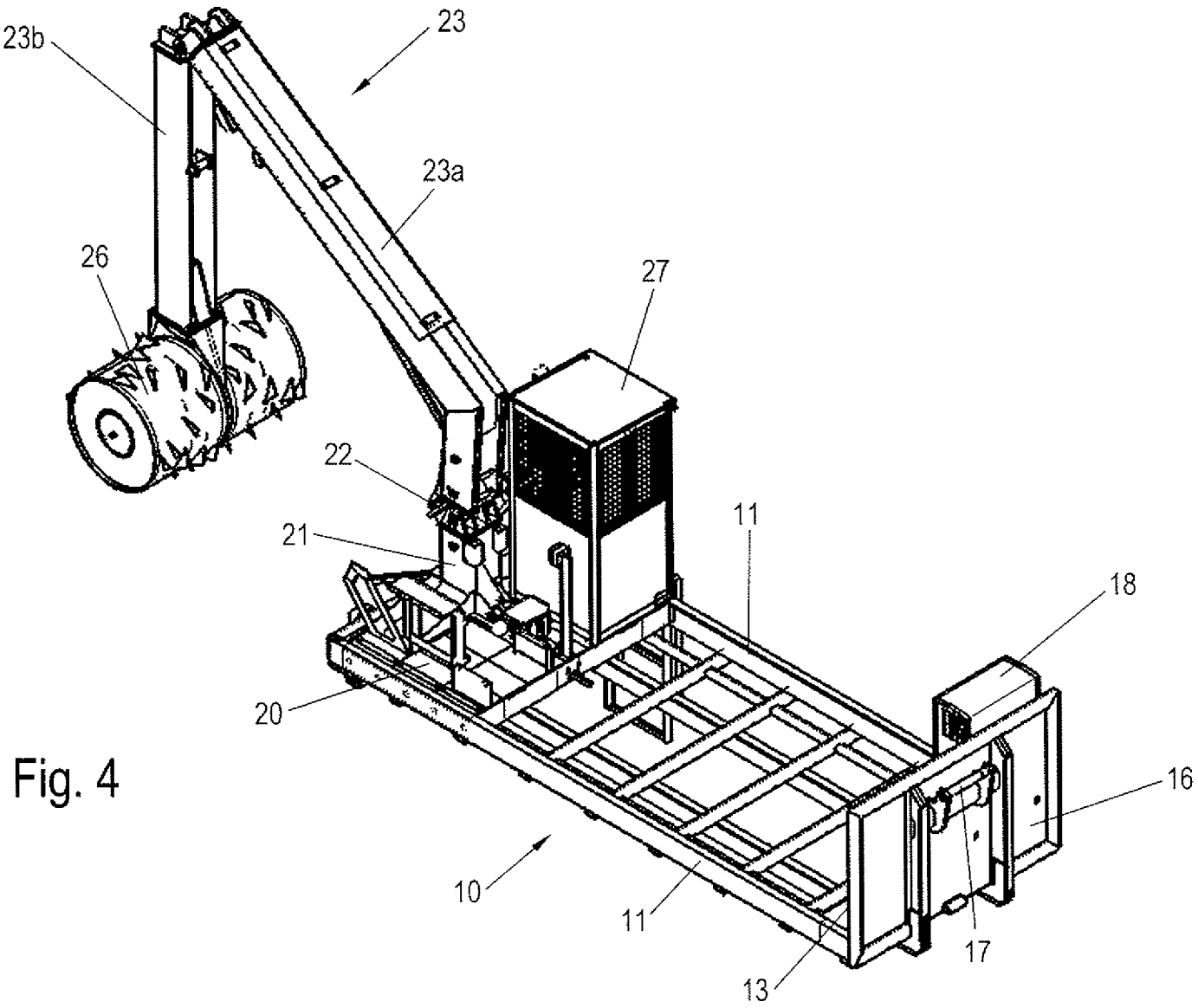

In a next step, the carriage 20 is then moved with the raised articulated arm 23 from the front end of the base structure 10 to the rear end of the base structure 10. FIG. 3 shows the roller compactor with the carriage 20 in the corresponding position. By moving the the carriage 20 in the direction of the rear end of the roller compactor, the articulated arm 23 and thus the compactor roller 26 are moved in the direction of the container.

Subsequently, the compactor roller 26 is lowered into the container by pivoting the pivot joint 22. Finally, FIG. 5 shows the roller compactor during operation, wherein the compactor roller 26 can be actively driven back and forth in the container.

For the transition between the rest position (FIG. 1) and the working position 5 (FIG. 5), only a limited pivotability of clearly less than 90° of the articulated arm 23 is required. This is achieved in that the articulated arm 23 can be moved so that the front, second articulated arm member 23*b* does not have to be struck over the first articulated arm member 23*a*, but can be folded under it. This movement is performed with a smaller pivot angle of the pivot joint 22.

On the movable carriage 20, a cabin 27 is also provided for operating the roller compactor. The roller compactor is controlled via the supply cabinet 18, in which, among other things, a sequence control is arranged. In order to bring the compactor roller 26 from the rest position into the working position and back again, a program controller can be provided, which carries out the necessary movement sequence and the coordination between the movement of the articulated arm 23 and that of the carriage 20 upon actuation of only one operating element.

FIG. 7 shows a section of the roller compactor in the working position in a likewise isometric view from a different viewing direction than in FIGS. 1 to 5. FIG. 7 provides an insight into the cabin 27. In order to prevent an unwanted displacement between the operating position and the rest position or vice versa, electronic protective measures can be adopted. For example, a special key switch can be provided, which allows the transition between rest and working position only in a separate key position.

Moreover, in the illustrated exemplary embodiment, a mechanical lock in form of a locking slide 28 is provided. The locking slide 28 can be operated within the cabin 27. In the embodiment shown, it is formed by a vertically movable bolt, which is guided through a floor of the cabin 27 and engages in a bore in a component of the base structure 10 in the rest position and in the working position. Movement of the movable carriage 20 is prevented purely mechanically by the locking slide 28 when it is in engagement with the base structure 10. A switch or sensor, which detects the position of the locking slide 28 and can be interrogated by the sequence control, can additionally be arranged on the locking slide 28. In this way, a movement of the movable carriage 20 can already be prevented by the controller when the locking slide 28 is in the locking position. In alternative embodiments, the locking slide 28 can also be moved automatically, also driven by the sequence control, e.g., electromechanically or hydraulically.

Further, in FIG. 7, a ladder 29 can be seen, which reaches down on the side of the truck or trailer on which the roller compactor is mounted, and allows access to the cabin 27. The ladder 29 is designed so as to be able to be folded up by a joint arranged in the lower region of the cabin 27 and can serve as a fall protection in the folded-up state for an operator of the roller compactor, who is in the cabin 27. Alternatively or additionally, for the case in which the ladder 29 is not folded up, a safety bracket that can be tilted or pivoted in front of the entrance of the cabin 27 can be provided as a fall protection. An attachable chain can also be used as an anti-fall device.

FIG. 7 further shows supporting elements (not shown in closer detail) that are fixed to the movable carriage 20 and prevent a lateral movement of the compactor roller 26 in the rest position.

In addition, bottom rollers 19 arranged on the underside of the base frame can be seen with which the roller compactor rolls over the ground with its rear end during the winding onto the truck or the trailer.

Different drive types can be provided for the roller compactor for the movement of the articulated arm 23, for the rotation of the compactor roller 26, and for the displacement of the carriage 20. All of the aforementioned movable elements can, for example, be hydraulically driven, wherein a hydraulic pressure necessary for this is provided either via a diesel generator mounted on the roller compactor or via an electrically driven hydraulic pump. Alternatively and/or additionally, a hydraulic connection to the truck can also be established and the hydraulic pressure necessary for operating the roller compactor can be provided by a hydraulic pump of the truck.

In alternative embodiments, a partly hydraulic, partly electric drive is possible. For example, the movement of the articulated arm 23 and the rotation of the compactor roller 26 can be effected hydraulically, while the displacement of the carriage 20 is carried out by means of an electric motor. An electrical drive can be operated in a network-connected manner, for example by connecting a corresponding power supply cable, preferably a three-phase power line, to the supply cabinet 18. Furthermore, the roller compactor can be provided with rechargeable batteries (accumulators), which at least temporarily enable a supply of electrical components independently of a mains power supply.

In a further embodiment, which is not shown in the drawings, hydraulically extendable supports for supporting purposes can be arranged on the base structure 10. The hydraulic supports can be pivotably attached to the base structure 10 so that they do not protrude laterally or only slightly beyond the base structure 10 when the roller compactor is transported. It is advantageous in the case of a hydraulic support that, after positioning the transportable roller compactor by means of a truck or a trailer, the hydraulic roller compactor can be supported on the supports and can also rise above the loading surface of the truck or trailer so that it can extend under the roller compactor and is not required during the operation of the roller compactor.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

10 Base structure
11 Longitudinal beam
12 Rear transverse beam
13 Front transverse beam
14 Bearer
15 Transverse beam
16 End wall
17 Eyelet
18 Supply cabinet
19 Bottom roller
20 Movable carriage
21 Support column
22 Ankle joint
23 Articulated arm
23*a* First articulated arm member
23*b* Second articulated arm member
24 Hooking apparatus
25 Stop
26 Compactor roller
27 Cabin
28 Locking slide
29 Ladder

What is claimed is:

1. A transportable roller compactor for compacting waste located in an open-top container, comprising:

a base structure comprising a plurality of beams, wherein the transportable roller compactor is configured to mount on a truck or a trailer of a truck in a transport direction, wherein the base structure has front and rear ends, wherein the front end of the base structure is closer to a front end of the truck or trailer than the rear end of the base structure;

an articulated arm is supported at one end by the base structure and carries at its other, free end a compactor roller rotatable about a horizontal axis of rotation; and a carriage that is mounted so as to be displaceable on the base structure in a longitudinal direction, wherein the articulated arm is pivotably mounted on the carriage, wherein a length of the carriage in the transport direction is less than a length of the base structure in the transport direction so that the carriage is displaceable between the front and rear ends of the base structure, wherein, in a rest position of the articulated arm, the carriage is disposed at the front end of the base structure, and wherein, in a working position of the articulated arm, the carriage is disposed at a rear end of the base structure.

2. The transportable roller compactor of claim 1, wherein the plurality of beams includes longitudinal beams on which the carriage is guided.

3. The transportable roller compactor of claim 1, wherein the articulated arm is pivotably mounted on the carriage via a pivot joint and a support column.

4. The transportable roller compactor of claim 3, wherein the pivot joint has a pivot angle of less than 90°.

5. The transportable roller compactor of claim 3, wherein the pivot joint has a pivot angle of less than 75°.

6. The transportable roller compactor of claim 1, wherein the carriage is movable on the base structure via a hydraulically or electromotively operated chain or rack drive.

7. The transportable roller compactor of claim 1, wherein the articulated arm comprises two articulated arm members that are pivotable relative to each other and of which a first articulated arm member, which is mounted on the carriage.

8. The transportable roller compactor of claim 7, wherein in the rest position the compactor roller is positioned beneath the first articulated arm member.

9. The transportable roller compactor of claim 8, wherein in the rest position the compactor roller is disposed on the carriage.

* * * * *